US007488238B2

(12) United States Patent
Liao

(10) Patent No.: US 7,488,238 B2
(45) Date of Patent: Feb. 10, 2009

(54) EMERY WHEEL GRINDING MACHINE WITH ADJUSTABLE DRILL BIT CHUCK

(75) Inventor: Ming-Ko Liao, Ta-Li (TW)

(73) Assignee: Taiwan More-Cash Villager Corp., Taichung (TW)

( * ) Notice: Subject to any disclaimer, the term of this patent is extended or adjusted under 35 U.S.C. 154(b) by 0 days.

(21) Appl. No.: 11/761,544

(22) Filed: Jun. 12, 2007

(65) Prior Publication Data

US 2008/0311829 A1 Dec. 18, 2008

(51) Int. Cl.
*B24B 9/00* (2006.01)

(52) U.S. Cl. ..... 451/234; 451/48; 451/279; 451/282; 451/293

(58) Field of Classification Search ..... 451/48, 451/231, 232, 234, 236, 278, 279, 282, 293
See application file for complete search history.

(56) References Cited

U.S. PATENT DOCUMENTS 4,016,680 A * 4/1977 Moores et al. ..... 451/72
4,093,247 A * 6/1978 Bernard et al. ..... 279/53
4,468,891 A * 9/1984 Giebmanns ..... 451/221

* cited by examiner

*Primary Examiner*—Timothy V Eley
(74) *Attorney, Agent, or Firm*—Lowe Hauptman Ham & Berner, LLP

(57) ABSTRACT

The emery wheel grinding machine with adjustable drill bit chuck disclosed herein has an adjustable chuck in which is provided with a T-bushing having an outer flange formed at one end thereof. The outer flange is provided with several pairs of stop traps along its circumference, whereas the number of stop traps are determined according to the number of cutter blades to be shaved. Several stop pins are formed on the surface of the outer flange to control the turning angle of the drill bit or the cutter. The T-bushing further has a taper hole in it. When the chuck head which holds the drill bit or the cutter is inserted into the taper hole, the cutter blade can be in contact with the emery wheel with a certain tilted angle thereby allowing the cutter blades of various length and number to be effectively shaved, ground and finished.

4 Claims, 8 Drawing Sheets

EMERY WHEEL GRINDING MACHINE WITH ADJUSTABLE DRILL BIT CHUCK

BACKGROUND OF THE INVENTION

1. Field of the Invention

The present invention relates to emery wheel grinding machine with an adjustable chuck, and more particularly, to an emery wheel grinding machine equipped with an adjustable drill bit chuck suitable for shaving the drill bit or a cutter of a two or more faced and variously lengthed blade of a hobbing cutter other than a single blade one.

2. Description of the Related Art

A conventional portable grinding machine, as it was disclosed and published by Taiwan Pat. No. 286610, 155338, is composed of a housing, a cap covered at one end thereof, a transmission gearing equipped in the housing, a emery wheel and guiding members. When it is to be used, the whole unit is set on an electric motor with the grinding machine coupled with the main shaft of the electrical drill so as to impart the rotational power of the electrical drill to the emery wheel with transmission gearing for running. At the same time, a drill bit or cutter to be shaved is affixed to the machine unit with the guiding members so as to shave and grind the drill bit or cutter blade to a desired extent.

With the grinding machine described above, the grinding or shaving effect can only reach to the very small part surrounding the central pointed drill head without reaching further to the portion of the blade edge at the recessed clearance, that greatly degrades the effect of finishing drill bit.

For an improvement, the applicator invented an innovative Portable Drill Bit Grinding Machine which was patented by Taiwan Pat. No. 547228. As shown in FIG. 1, this newly developed apparatus is essentially composed of an emery wheel 20 driven by a power source associated with a work fixture and a drill bit fixing means 30 for operation. The work fixture is cooperated with a first grinding base 40 for the purpose of affixing the blade of the drill bit in such a manner that its clearance angle is closely fitted to the tilted grinding surface 21 of the emery wheel 20. Then, the work fixture is cooperated with a second grinding base 50 for the purpose of affixing the blade of the drill bit in such a manner that its spiral angle to be closely fitted to the tilted grinding surface 21 of the emery wheel 20.

As shown in FIG. 1, the drill bit fixing means 30 comprises a work fixture fastening base 31 for setting the work fixture, and a drill bit fastening jig 32. The work fixture fastening base 31 is provided with a mounting hole that allows the work fixture to be engaged in, and a rotation limiting post with a prescribed angle provided at the circumference of the mounting hole.

The first grinding base 40 is engaged to a machine housing 10 in front of the emery wheel 20 aligned in the same center line, and is kept a distance with the emery wheel 20 equal to that between the work fixture fastening base 31 and the drill bit fastening jig 32. The first grinding base 40 is approximately configured in L shape with an arcuate sliding slot 41 formed at the base surface thereof. By fastening the arcuate sliding slot 41 with a bolt 42, the first grinding base 40 can practically keep a relevant angle with the emery wheel 20 so as to grind and shave a variety of drills such as standard drill, rugged drill, or ebonite drill having the blades of different clearance angles and recesses.

The first grinding base 40 has a vertical wall 46 on which being provided with a mounting hole 43 for engaging the work fixture therein, and two rotation limiting posts 44, 45 with a prescribed angle and distance are formed at the circumference of the mounting hole 43. The mounting hole 43 is upwardly inclined with an angle about 10~25° in order to fit the direction of the blade of the drill bit to be shaved.

The second grinding base 50 is engaged to the machine housing 10 with a bolt 51 above the emery wheel 20 keeping a distance with the latter equal to that between the work fixture fastening base 31 and the drill bit fastening jig 32. The second grinding base 50 has a mounting hole 52 for engaging the work fixture therein and a rotation limiting post 53 with a prescribed angle standing on the circumference of the mounting hole 52.

However, the improved portable grinding machine patented by No. 547,228 described above is still having a limited use for grinding conventional drill or cutter only, it is inapplicable to a particular drill or cutter with two or more blades.

For these defects noticeable on the prior art, further improvement is seriously required. The inventor has dedicated great efforts for years to studying and improving these defects and came up with the present invention to be disclosed herein.

SUMMARY OF THE INVENTION

The present invention is to provide an emery wheel grinding machine with adjustable bit chuck which has a tilted T-bushing, and its outer flange is provided with several stop traps with the number corresponding to that of the blades of a bushing is also provided with two stop pins for defining the turning angle of the head of the hobbing cutter.

The tilted T-bushing of the present invention is not only able to adjust the chuck angle according to the figure and number of blades of the hobbing cutter, but also can control the turning angle of the hobbing cutter with the stop pins so that the clearance angles and the recesses between the blades can be effectively shaved.

The above object and other advantages of the present invention will become more apparent by describing in detail the preferred embodiments of the present invention with reference to the attached drawings.

DETAILED DESCRIPTION OF PREFERRED EMBODIMENTS

Figure 1:
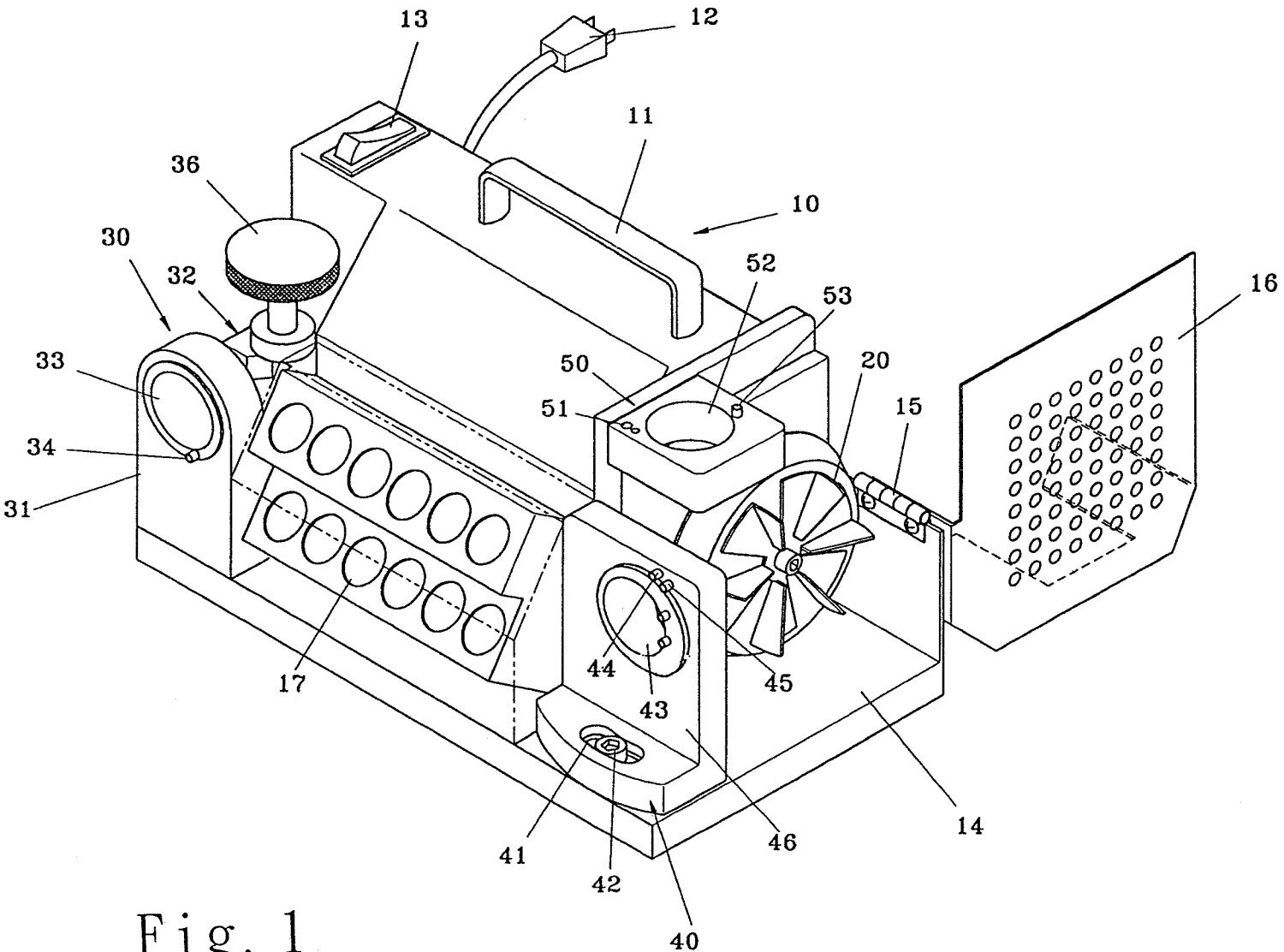
FIG. 1 is the three dimensional view of The Portable Drill Bit Grinding Machine Patented by Taiwan Pat. No. 547,228.
Figure 2:
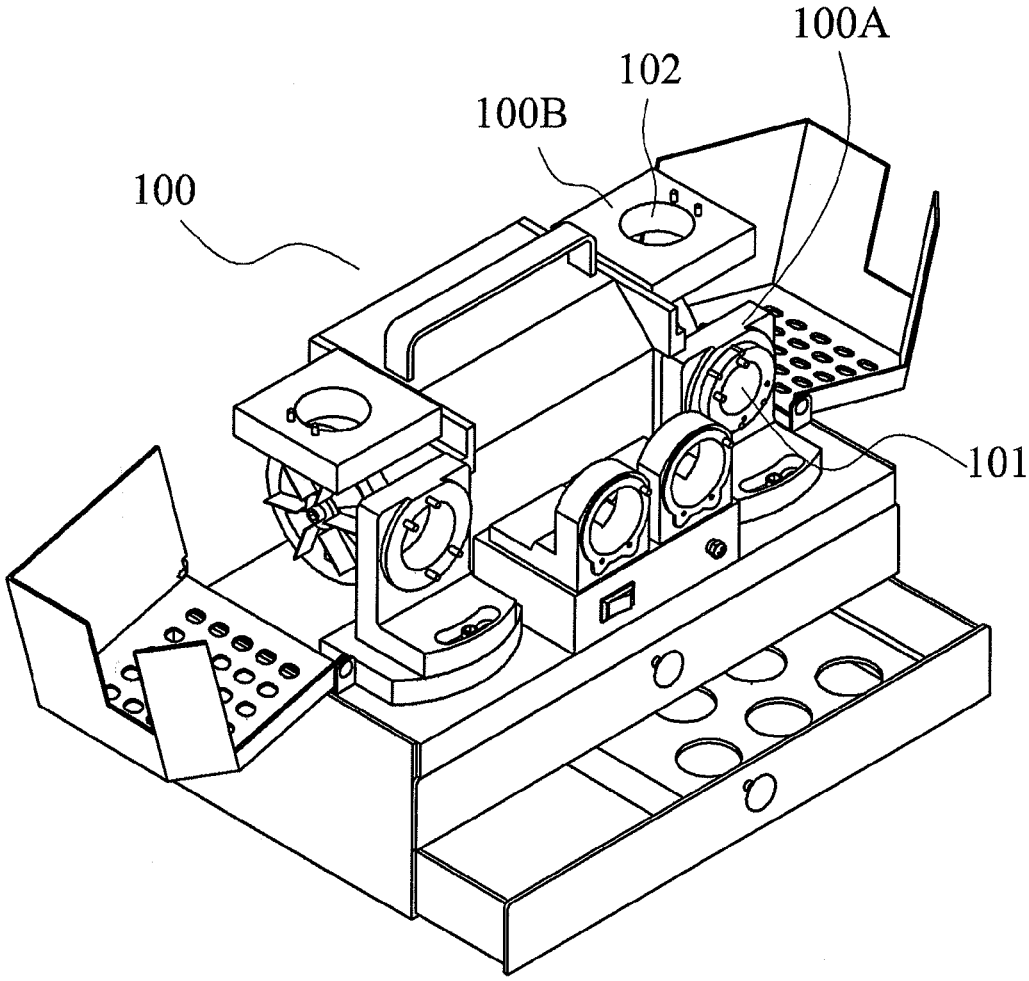
FIG. 2 is the three dimensional view of the present invention.
Figure 3:
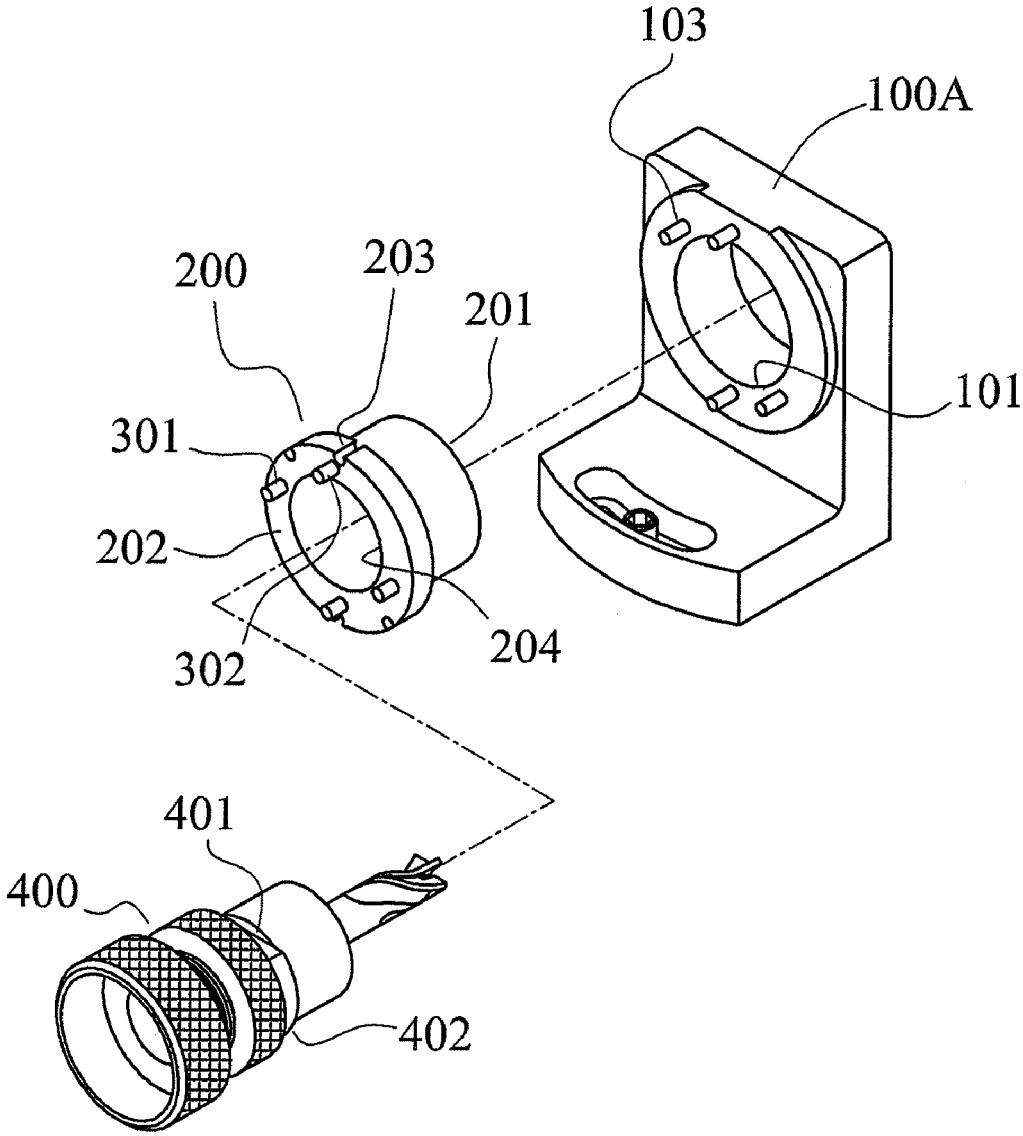
FIG. 3 is the three dimensional view of the T-bushing, chuck head and chuck according to the present invention.

Referring to FIG. 2 and FIG. 3, the adjustable drill bit chuck of the present invention which accommodates a grinder 100, is provided with a first drill chuck 100A and a second drill chuck 100B. The former has a containment hole 101, and the latter has a T-bushing 200 with a containment hole 102 respectively. One end 201 of the T-bushing 200 can be inserted into the containment hole 101, while the other end has a larger outer diameter such that an outer flange 202 is emerged out of the containment hole 101 after insertion. Two, three, or four pairs of stop traps 203 are provided along the circumference of the outer flange 202 according to the number of blades of the drill or hobbing cutter to be shaved. The stop traps 203 can be engaged with corresponding clamp studs 103 which are provided on the outer surface of the drill chuck so as to hold the T-bushing 200 in place in the containment hole 101 of the drill chuck.

Figure 4:
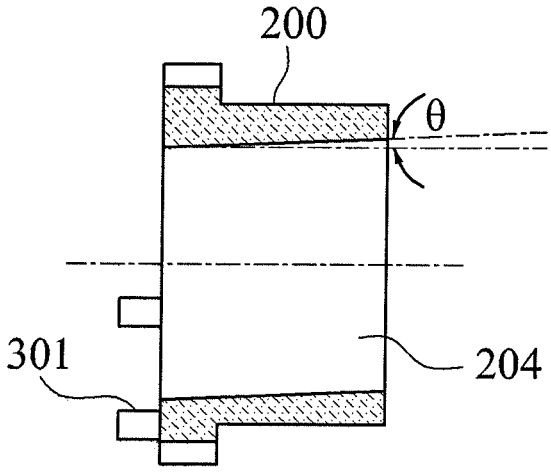
FIG. 4 is the sectional view of the T-bushing according to the present invention.

Referring to FIG. 4, the T-bushing 200 has a tapered hole 204 in it with a taper angle such that the blade of the drill or hobbing cutter can keep a prescribed inclination angle with the emery wheel when the drill or cutter head is inserted into the tapered hole 204.

Returning to FIG. 3, in the present invention, the adjustable drill chuck is provided with two pairs of stop pins 301, 302 along the outer flange 202 of the T-bushing 200 so as to control the turning angle of the drill bit chuck. As shown in FIG. 3, after inserting the adjustable check head having confinement grooves 401, 402 into the tapered hole 204, the confinement grooves 401, 402 and the stop pins 301, 302 cooperate to control the turning angle of the chuck head 400 by their mutual positional relation thereby defining the length of the cutter blade to be shaved.

Figure 5:
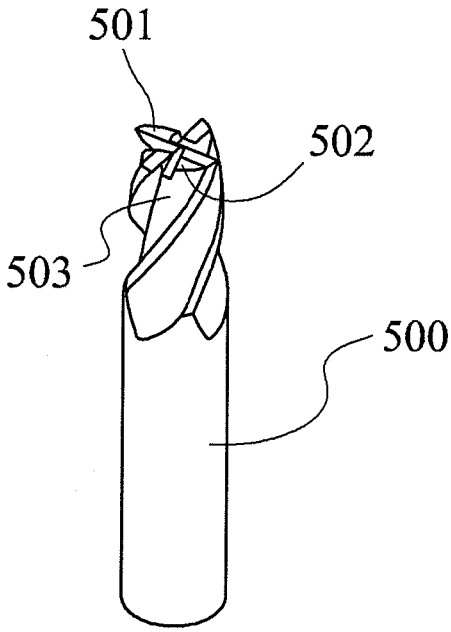
FIG. 5 is the three dimensional view of a hobbing cutter.

Referring to FIG. 5, in the present invention, the T-bushing 200 of the adjustable chuck is not only for holding a hobbing cutter 500 to be shaved by exposing a blade length 501, but also can serve in the second drill chuck 100B to 501, but also can serve in the second drill chuck 100B to finish the clearance angles 502 or recesses 503 of the cutter blades.

Figure 6:
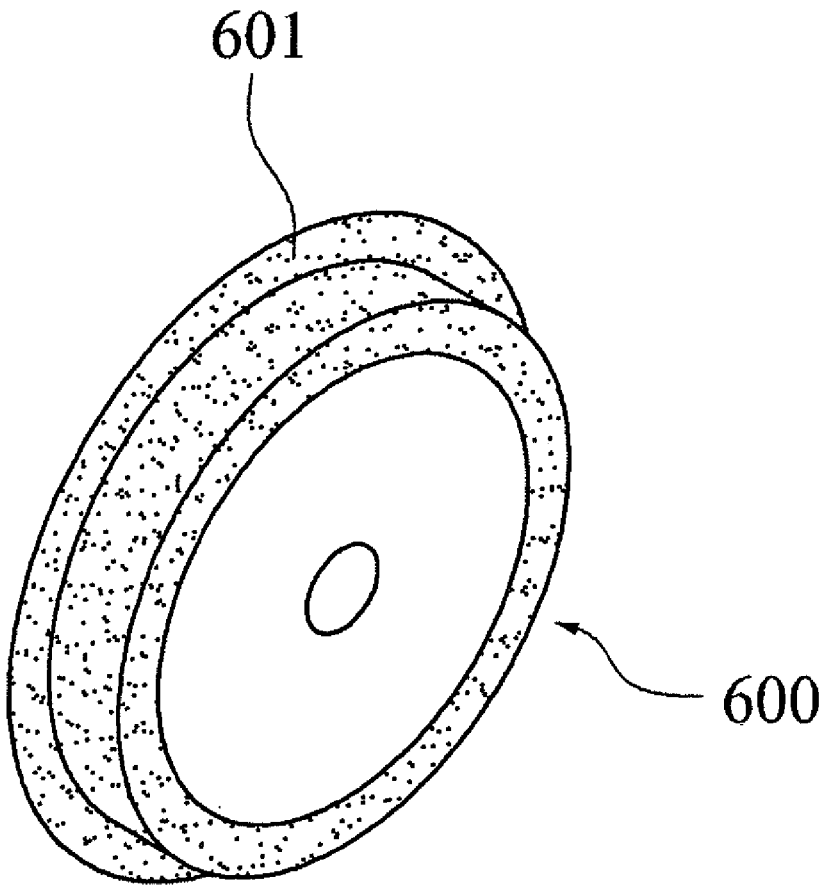
FIG. 6 is a three dimensional view of the emery wheel with an outer annular ring according to the present invention.

Referring to FIG. 6, if a tilted T type emery wheel 600 is used in the present invention, it is provided an outer ring 601 with larger diameter than that of the main wheel 600 at one side thereof, the grinding surface of the outer ring 601 is covered with a preferably thick emery compounds.

Figure 7:
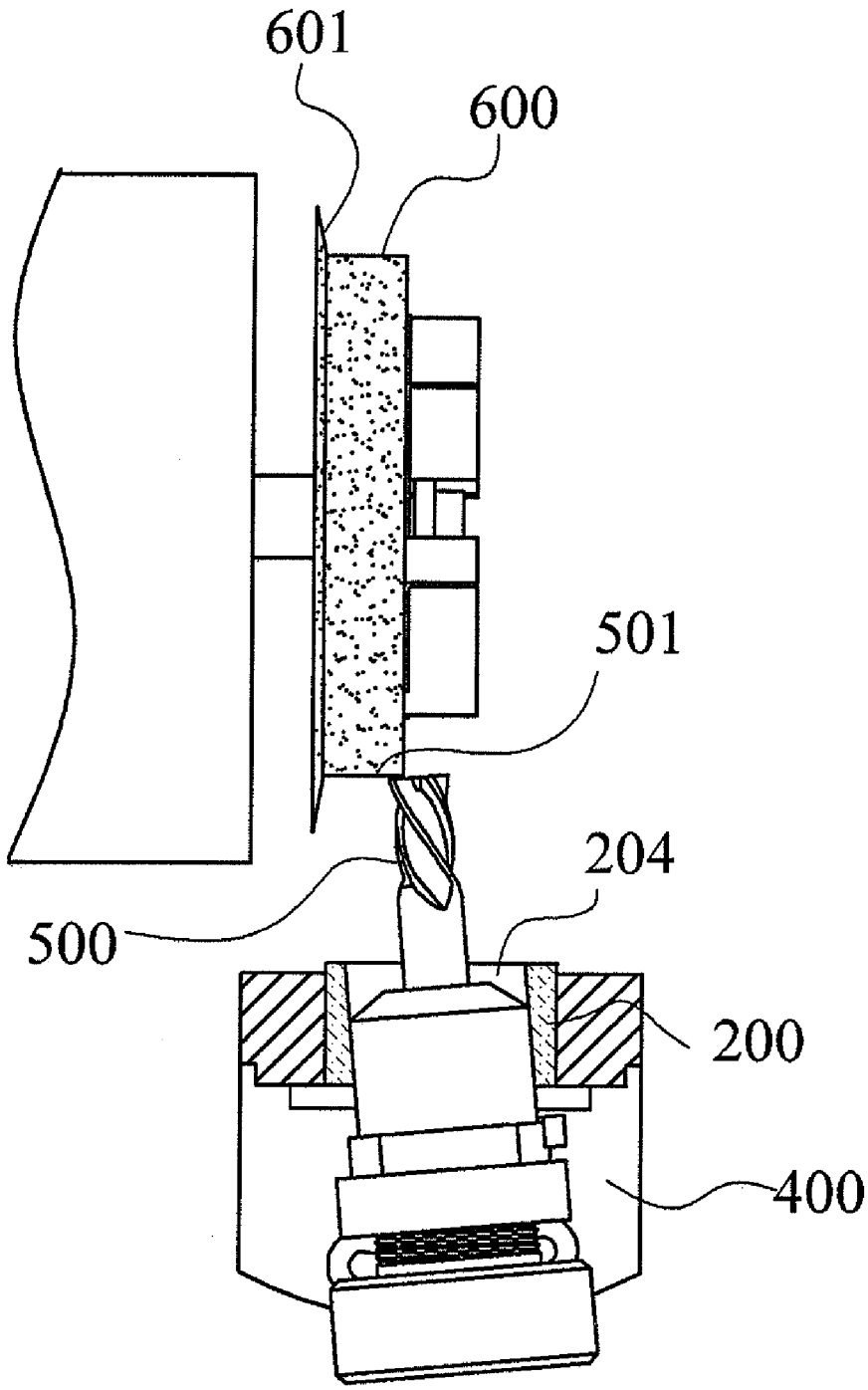
FIG. 7 is a schematic view of a hobbing cutter whose blades are to be shaved.
Figure 8:
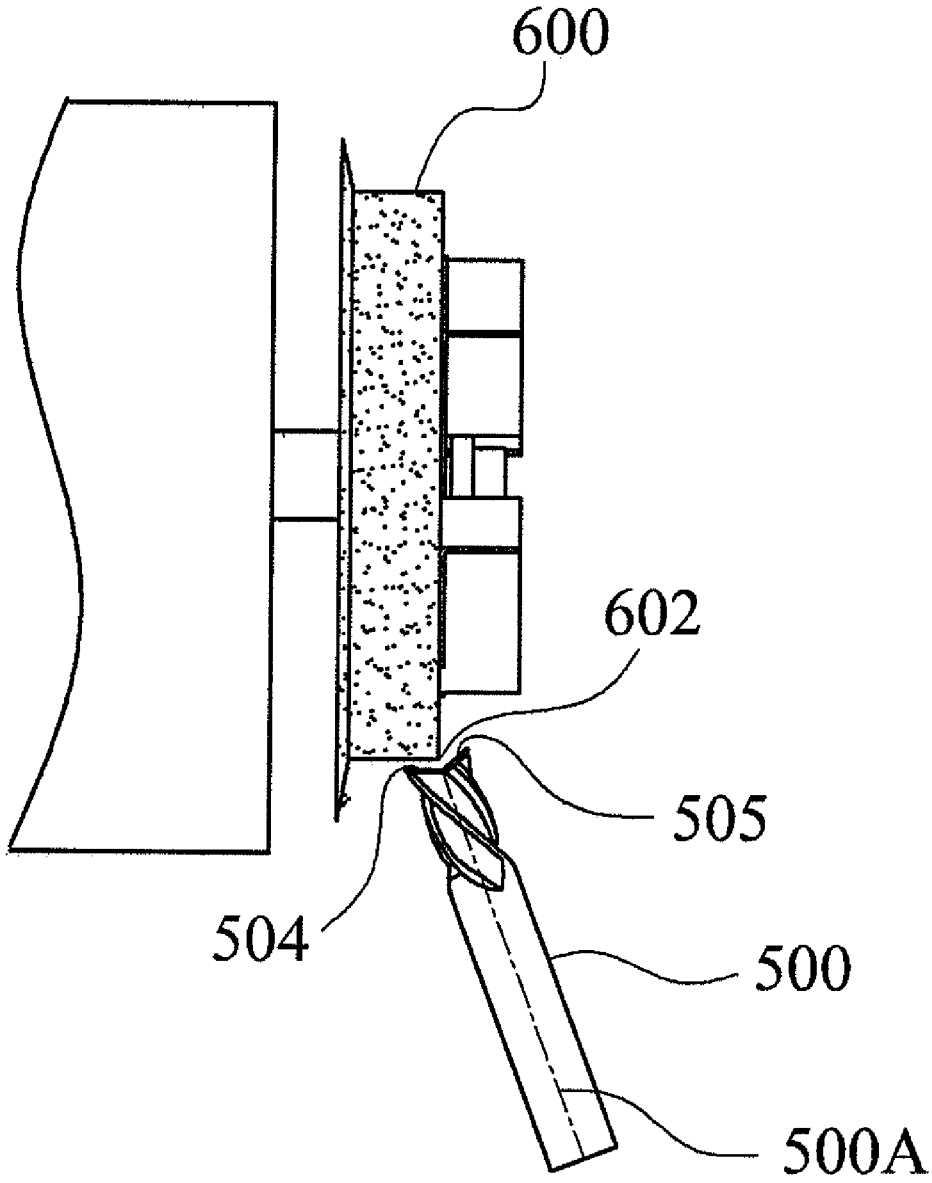
FIG. 8 is a schematic view of another example other than that shown in FIG. 7.

Referring to FIG. 7, when the blades of a hobbing cutter 500 is to be shaved, at first the T-bushing 200 is inserted into the Z direction containment hole 101 of the first drill bit chuck 100A, then the chuck head 400 holding the hobbing cutter 500 at the chuck side is inserted into the tapered hole 204 in the T-bushing 200 so as to bring the hobbing cutter 500 in contact with the main body of the emery wheel 600 with a tilted angle θ. As the emery wheel 600 rotates, by turning the chuck head 400 according to the mutual positional relation between the confinement grooves 401, 402 and the stop pins 301, 302, the hobbing cutter 500 can be settled to shave its blade. Taking the cutter with two-faced blade for example, as soon as one side of the blade is finished, turning the T-bushing 200 180° and inserting it into the Z direction containment hole 101 of the first drill bit chuck 100A so as to continue shaving the other side of the blade. The body of the emery wheel 600 engages the blades at a tilted angle θ, the so that tilted blade can be easily shaved. As shown in FIG. 8, by means of inclining center 500A of the cutter 500 against the corner 602 of the emery wheel 600, the blades 504, 505 with different length can be effectively shaved by turning the chuck head from 0° to 180°.

Figure 9:
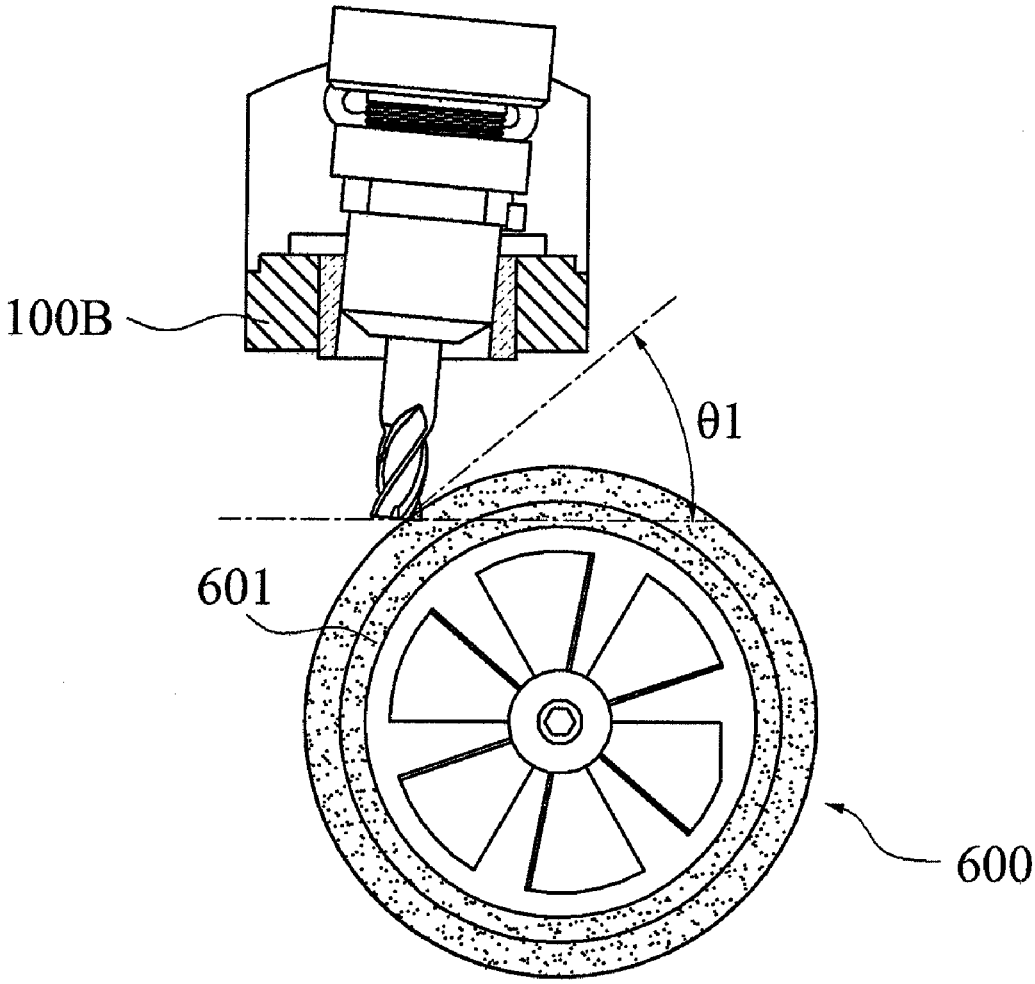
FIG. 9 is a schematic view showing the clearance angle of a hobbing cutter which is under shaving.

Referring to FIG. 9, when a clearance angle θ1 of the hobbing cutter 500 is to be shaved, at first the T-bushing 200 is inserted into the Y direction containment hole 101 of the second bit chuck 100B, and then by inserting the chuck head 400 which holds the hobbing cutter 500 into the tapered hole 204 of the T-bushing 200 such that the hobbing cutter 500 is in contact with the outer ring 601 of the emery wheel 600 with a tilted angle θ thereby making the cutter 500 to incline a certain angle against the edge 602 of the outer ring 601. By so, the clearance angle of the blade of the cutter 500 can be easily shaved.

Accordingly, by utilizing the T-bushing 200 with the tapered hole 204 together with the emery wheel 600 with the outer ring 601, the present invention can be applied to shave and finish the hobbing cutter 500 with two, three or even four blades conveniently and easily only by turning the T-bushing 200.

Although the present invention has been disclosed and illustrated with respect to preferred embodiments thereof, it is to be understood that the invention is not to be so limited and that other changes and modifications can be made within the full intended scope of the invention as hereinafter claimed.

What is claimed is:

1. Emery wheel grinding machine with adjustable drill bit chuck comprising:

an emery wheel for grinding and shaving a drill bit; a drill bit chuck for fastening a drill bit; said drill bit chuck including a plurality of clamp studs and a bushing in said chuck for insertion of the head of said drill bit;

wherein said bushing is a T-shaped bushing having an outer flange, one end thereof can be inserted into a containment hole, and the other end including the outer flange extends out of said containment hole, said outer flange is provided with several pairs of stop traps along its circumference and can be engaged with said corresponding clamp studs provided on an outer surface of said drill bit chuck, and said T-bushing has a tapered hole in it.

2. The grinding machine as in claim 1, wherein the surface of said outer flange of said T-bushing is provided with two pairs of stop pins for controlling the turning angle of said drill bit chuck.

3. The grinding machine as in claim 1, wherein the number of said stop traps provided along the circumference of said outer flange of said T-bushing is determined according to the number of cutter blades to be shaved.

4. The grinding machine as in claim 1, wherein the grinding wheel used in said grinding machine is an emery wheel provided with an outer ring with a larger diameter than that of the main wheel.

* * * * *